US011313384B2

(12) United States Patent
Martens et al.

(10) Patent No.: US 11,313,384 B2
(45) Date of Patent: Apr. 26, 2022

(54) FLOW-THROUGH ARRANGEMENT

(71) Applicant: Siemens Energy Global GmbH & Co. KG, Munich (DE)

(72) Inventors: Uwe Martens, Duisburg (DE); Nico Petry, Oberhausen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/645,098

(22) PCT Filed: Aug. 20, 2018

(86) PCT No.: PCT/EP2018/072378
§ 371 (c)(1),
(2) Date: Mar. 6, 2020

(87) PCT Pub. No.: WO2019/057412
PCT Pub. Date: Mar. 28, 2019

(65) Prior Publication Data

US 2020/0277967 A1 Sep. 3, 2020

(30) Foreign Application Priority Data

Sep. 20, 2017 (EP) ..... 17192114

(51) Int. Cl.
*F04D 29/44* (2006.01)
*F04D 29/28* (2006.01)
*F04D 29/30* (2006.01)

(52) U.S. Cl.
CPC ..... *F04D 29/444* (2013.01); *F04D 29/284* (2013.01); *F04D 29/30* (2013.01);
(Continued)

(58) Field of Classification Search
CPC ... F04D 29/444; F04D 29/284; F05D 2250/00
See application file for complete search history.

(56) References Cited

U.S. PATENT DOCUMENTS 2,372,880 A 4/1945 Browne
3,460,748 A * 8/1969 Erwin ..... F04D 29/442 415/98

(Continued)

FOREIGN PATENT DOCUMENTS

CN 101091080 A 12/2007
CN 101868630 A 10/2010

(Continued)

OTHER PUBLICATIONS

PCT International Search Report and Written Opinion of International Searching Authority dated Nov. 20, 2018 corresponding to PCT International Application No. PCT/EP2018/072379 filed Aug. 20, 2018.

*Primary Examiner* — Courtney D Heinle
*Assistant Examiner* — Ryan C Clark

(57) ABSTRACT

An arrangement having an impeller that rotates about an axis and a stationary diffuser located downstream with guide vanes. The impeller has an inlet for an axial supply flow and an outlet for a radial out-flow, wherein radially and axially extending rotor blades are arranged between a wheel disc and a cover disc of the impeller. The impeller channels are separated from one another in a circumferential direction. The diffuser extends substantially radially along a main flow direction and has an axial channel width. The diffuser has a diffuser inlet and outlet, wherein guide vanes extending axially along a blade vertical direction and radially along a through-flow direction are arranged between the wheel disc side and the cover disc side of the diffuser, which separate the guide vane channels from one another. An inlet edge angle is smaller on the cover disc side than on the wheel disc side.

12 Claims, 4 Drawing Sheets

(52) U.S. Cl.
CPC .... *F05D 2220/40* (2013.01); *F05D 2240/121* (2013.01); *F05D 2250/52* (2013.01)

(56) References Cited

U.S. PATENT DOCUMENTS

| | | | | |
|---|---|---|---|---|
| 9,551,355 | B2 * | 1/2017 | Blair | F04D 29/444 |
| 9,581,170 | B2 * | 2/2017 | Holbrook | F04D 29/30 |
| 10,066,638 | B2 * | 9/2018 | Bessho | F04D 29/681 |
| 2006/0162792 | A1 | 7/2006 | Oh | |
| 2008/0038114 | A1 * | 2/2008 | Abdelwahab | F04D 29/444 415/211.1 |
| 2010/0021291 | A1 | 1/2010 | Beeck | |
| 2013/0094955 | A1 | 4/2013 | Ibaraki et al. | |
| 2017/0108003 | A1 | 4/2017 | Rusch | |
| 2017/0261001 | A1 * | 9/2017 | Masutani | F04D 29/284 |
| 2019/0345825 | A1 * | 11/2019 | Keating | F01D 5/048 |

FOREIGN PATENT DOCUMENTS

| | | | |
|---|---|---|---|
| CN | 102459980 | A | 5/2012 |
| CN | 103097741 | A | 5/2013 |
| CN | 104279011 | A | 1/2015 |
| CN | 204164041 | U | 2/2015 |
| CN | 106460870 | A | 2/2017 |
| DE | 102010020379 | A1 | 11/2011 |
| DE | 102014219107 | A1 | 3/2016 |
| DE | 102016201256 | A1 | 8/2017 |
| EP | 0648939 | A2 | 4/1995 |
| EP | 2650546 | A1 | 10/2013 |
| EP | 2778431 | A2 | 9/2014 |
| JP | S5469811 | A | 6/1979 |
| WO | 2010138119 | A1 | 12/2010 |
| WO | 2011011335 | A1 | 1/2011 |
| WO | 2011141425 | A1 | 11/2011 |
| WO | 2016046112 | A1 | 3/2016 |
| WO | 2017129342 | A1 | 8/2017 |

* cited by examiner

FLOW-THROUGH ARRANGEMENT

CROSS REFERENCE TO RELATED APPLICATIONS

This application is the US National Stage of International Application No. PCT/EP2018/072378 filed 20 Aug. 2018, and claims the benefit thereof. The International Application claims the benefit of European Application No. EP17192114 filed 20 Sep. 2017. All of the applications are incorporated by reference herein in their entirety.

FIELD OF INVENTION

The invention relates to an arrangement through which a process fluid is able to flow along a main flow direction, comprising an impeller which is rotatable about an axis in a direction of rotation, and an upright diffuser which is situated downstream of the impeller and is equipped with guide vanes, wherein the impeller has an inlet for a substantially axial inflow and has an outlet for a substantially radial outflow, wherein radially and axially extending rotor blades are arranged between a wheel disk and a cover disk of the impeller and delimit impeller channels with respect to one another in a circumferential direction, wherein the diffuser extends substantially radially along a main flow direction, wherein the diffuser has an axial cover disk side and an axial wheel disk side, which delimit between them an axial channel width of the diffuser, wherein the diffuser has a diffuser inlet for a substantially radial inflow and has a diffuser outlet, wherein guide vanes extending axially along a vane height direction and radially along a throughflow direction are arranged between the wheel disk side and the cover disk side of the diffuser and delimit guide vane channels with respect to one another in a circumferential direction.

BACKGROUND OF INVENTION

EP 2 650 546 A1 has already disclosed a corresponding arrangement. There, it is proposed to arrange the guide vanes in inclined form in an upright diffuser arranged downstream of the impeller (dihedral vanes). In particular in the case of the so-called "low solidity diffuser" (having guide vanes which have a relatively large spacing with respect to one another in a circumferential direction in comparison with their radial extent), the intention is to achieve a reduced pressure loss by means of this aerodynamic measure. However, since the flow pattern in the diffuser is significantly dependent on the flow conditions in and downstream of the impeller, the proposed measures can yield positive or negative effects according to the configuration of the impeller, and so the desired effect of this measure occurs only under other very particular aerodynamic boundary conditions or not at all.

DE 10 2010 020 379 A1 has already disclosed a settable radial compressor-diffuser in which the axial channel width of the substantially radially extending diffuser is formed to be variable.

DE 10 2014 219 107 A1 has already disclosed a radial compressor impeller whose cover disk and wheel disk are formed as beveled surfaces on the outer circumference.

DE 10 2016 201 256 A1 has already disclosed an arrangement of an impeller and a diffuser in which the individual diffuser guide vanes have different spacings to the axis of rotation.

EP 2 650 546 A1 has already disclosed the circumferentially inclined arrangement of guide vanes in a diffuser of a radial turbomachine.

The documents U.S. Pat. No. 2,372,880 A, EP 2 778 431 A2 and WO 2011/011335 A1 each present a three-dimensional diffuser guide vane configuration downstream of an open impeller. The flow conditions at an open impeller are not comparable with the flow conditions in a closed impeller on account of the no-slip condition alone, including at the flow-guiding stator opposite the wheel disk at the open impeller. Therefore, completely different flow patterns are obtained downstream of an open impeller, in particular with regard to the differences on the part of the wheel disk and the cover disk.

EP 0 648 939 A2 presents a turbomachine having a closed impeller.

EP 2 650 546 A1 presents a guide vane configuration having a bent profile center-of-gravity line along the vane height downstream of a closed impeller.

SUMMARY OF INVENTION

A three-dimensional configuration of impeller blades and diffuser vanes has hitherto scarcely followed a comprehensible technical teaching, which reliably improves the aerodynamics of the arrangement in comparison with conventional designs. The object of the invention is therefore to improve the aerodynamics, in particular of the guide vanes of the diffuser of such an arrangement, by means of the teaching according to the invention.

For the purpose of achieving said object, the invention proposes an arrangement of the type defined in the introduction, which is refined by means of the characterizing part of the main claim.

The individual guide vanes can be defined as a stack of vane profiles along a vane height. The vane profiles are in this case two-dimensional geometries which define the vane outer contour at a particular vane height position.

Here, in the context of the invention, a profile chord of a vane profile is to be understood as meaning an ("imaginary") straight connecting line between the profile leading edge (profile nose) and a profile trailing edge.

The angle of attack of a vane profile corresponds to the angle between the tangent to the profile chord and the tangent with respect to the circular movement of the rotor. Accordingly, the angle of attack is constant along the extent of the vane perpendicular to the vane height, that is to say substantially parallel to the main flow direction, and may vary along the vane height.

A mean line (line of curvature) describes a profile section or a profile of a vane at a particular height position in that the mean line (line of curvature) is a line defined by the center points of inscribed circles or circles tangent to the suction side and pressure side of the profile.

Expressions such as axial, radial, tangential or circumferential direction relate—if not stated otherwise—to an axis of rotation of the impeller of the arrangement. In particular the terms "tangential", "tangent" and associated expressions are used frequently in the description of the present invention, even with respect to another curve.

In the present case, a process fluid may be any gaseous, liquid or mixed-phase fluid. The process fluid moves through the arrangement along a main flow direction, said arrangement generally being a constituent part of a turbomachine. The outflow direction is to be understood to mean the average direction of movement of the process fluid in the region which, in the respective context, is defined by representative delimiting walls. For example, in the diffuser, the process fluid moves through individual flow channels, which are delimited axially, and delimited in a circumferential direction, by guide vanes, from a region of the inlet edges of the guide vanes radially outward into a region of outlet edges of the guide vanes. Since the guide vanes each have a curvature of the profile, reference may be made only to a substantially radial main flow direction. At any rate, the term "main flow direction" does not take into consideration local swirling and turbulence.

The impeller of the arrangement generally has a wheel disk and a cover disk. In this case, the wheel disk delimits flow channels of the impeller both radially inward (predominantly in the region of the inflow) and toward the axial side (increasingly, with approach to the impeller outlet), which is axially opposite the inflow side and through which a process fluid does not flow into the impeller. The cover disk constitutes that delimitation of flow channels of the impeller which is opposite the wheel disk. On the axial cover disk side, which is opposite the wheel disk side, the process fluid flows axially into the impeller and, for the flow channels of the impeller, is diverted radially outward. The cover disk side could therefore also be referred to as an inflow side. Flow channels of the impeller are delimited with respect to one another in a circumferential direction by means of rotor blades, wherein the rotor blades connect the wheel disk and the cover disk to one another.

In the context of the overall arrangement, the wheel disk and the cover disk in each case also define the wheel disk side and the cover disk side, to which reference is also made in the description of the diffuser. In the arrangement according to the invention, the inflow of the diffuser is always realized radially from the inside to the outside. Advantageously, in this case, the diffuser is also provided with a substantially radially outwardly directed outflow in the form of a diffuser outlet. It is basically conceivable for the diffuser also to be of curved form and for outflow possibly to be realized in a radial-axial, axial or radially inward manner. Basically, according to the invention, a portion of the diffuser always extends substantially radially. Said portion may be situated upstream of a diversion of the flow into an axial flow direction or into a radially inwardly directed flow direction.

It is proposed according to the invention that, for each axial vane height, an inlet edge angle is defined as the angle between an inlet edge tangent to a mean line at an inlet edge of the respective guide vane and a circumferential tangent through the inlet edge, wherein the inlet edge angle is smaller on the cover disk side than on the wheel disk side.

In this case, a circumferential tangent which extends through the inlet edge means that said circumferential tangent extends perpendicular to a radial through the inlet edge point of the respective profile section of the guide vane. Here, the inlet edge angle is the mathematically positively covered angle from the circumferential tangent to the inlet edge tangent to the mean line. This specification of the mean line configuration at the inlet edge for the wheel disk side with respect to the cover disk side of the diffuser guide vane leads to an inflow of the process fluid into the diffuser with relatively low loss.

One advantageous refinement of the invention provides that the difference between cover disk-side and wheel disk-side inlet edge angles is at least 5°. One configuration according to the invention of the invention with this order of magnitude leads to a significant improvement in the aerodynamic properties of the arrangement.

Another advantageous refinement of the invention provides that the angle of attack of the guide vanes is smaller on the cover disk side than on the wheel disk side. This configuration additionally takes into consideration the difference in the flow pattern downstream of the outlet from the impeller between the cover disk side and the wheel disk side, with the result that the aerodynamics are further improved.

This improvement becomes all the more pronounced if the difference between cover disk-side and wheel disk-side angles of attack of the guide vanes is at least 5°.

Another refinement of the invention provides that the flow downstream of the outlet from the impeller is particularly expediently prepared upstream of the inlet into the diffuser if the quotient of axial channel width of the diffuser equipped with vanes and maximum impeller outlet diameter is greater than 0.04.

Another advantageous refinement of the invention provides that the quotient of axial channel width of the diffuser equipped with vanes and axial channel width of the impeller at the maximum impeller outlet diameter is less than 0.95. In this way, the flow is accelerated upon entry into the diffuser such that the formation of swirling downstream of the impeller is reduced.

According to a further advantageous refinement of the invention, the guide vanes are designed such that an angle between a tangent to the mean line in the inlet edge region and a tangent to the mean line in the outlet edge region is smaller on the cover disk side than on the wheel disk side. In other words, this feature can be characterized in that a diversion function predefined by the respective profile is not as strong on the cover disk side as on the wheel disk side. This configuration also advantageously concerns the particular flow situation of the process fluid downstream of the outlet from the impeller and upstream of the inlet into the diffuser.

Another advantageous refinement of the arrangement according to the invention has a similar effect, in which refinement the guide vanes are designed such that an angle between a tangent to the mean line in the inlet edge region and the profile chord is smaller on the cover disk side than on the wheel disk side. In this case, the angle between a tangent to the mean line in the inlet edge region and the profile chord is defined as the mathematically positive angle from the tangent to the mean line in the inlet edge region to the profile chord.

Another advantageous refinement of the invention provides that the guide vanes have an inclination such that, on the cover disk side, the inlet edge, in relation to the wheel disk-side inlet edge, is offset counter to the direction of rotation of the impeller by at least 10% of the axial channel width of the diffuser. In particular in combination with the individual or some refinements of the invention that have already been described above, this configuration additionally takes into consideration the differences in the flow pattern downstream of the outlet from the impeller between the cover disk side and the wheel disk side.

With reference to such an inclination of the inlet edge in a circumferential direction, it is also possible for the outlet edge to be inclined in a circumferential direction, wherein, according to an advantageous refinement of the arrangement, it is particularly expedient if the guide vanes are designed such that an offset counter to the direction of rotation of the impeller at the outlet edge from the cover disk side in relation to the wheel disk side is smaller than at the inlet edge.

Harmonic flow guidance with low pressure loss is achieved in particular if the axial profile (profile in height direction) of the guide vanes of the diffuser from the cover disk side to the wheel disk side is of continuously curved form.

BRIEF DESCRIPTION OF THE DRAWINGS

The invention is illustrated in more detail below on the basis of a specific exemplary embodiment with reference to the drawings, in which.

DETAILED DESCRIPTION OF INVENTION

Figure 1:
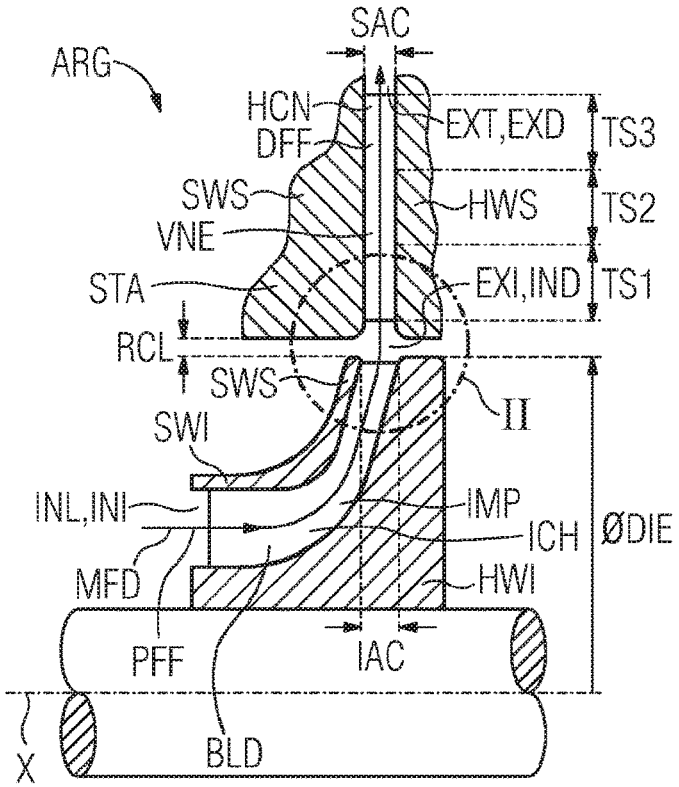
FIG. 1 shows a schematic longitudinal section through an arrangement according to the invention.
Figure 2:
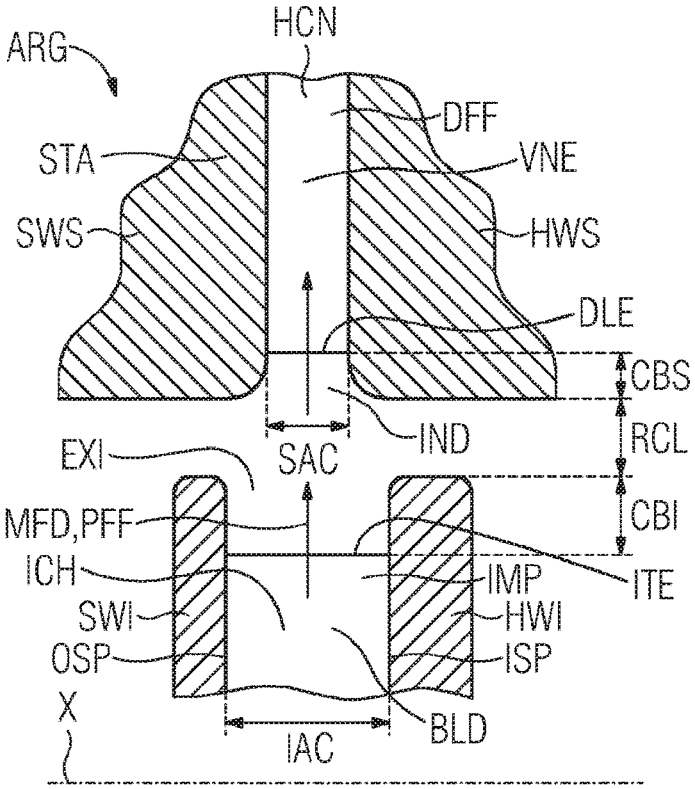
FIG. 2 shows a schematic longitudinal section through an arrangement according to the invention in the form of a detail II as per FIG. 1.
Figure 3:
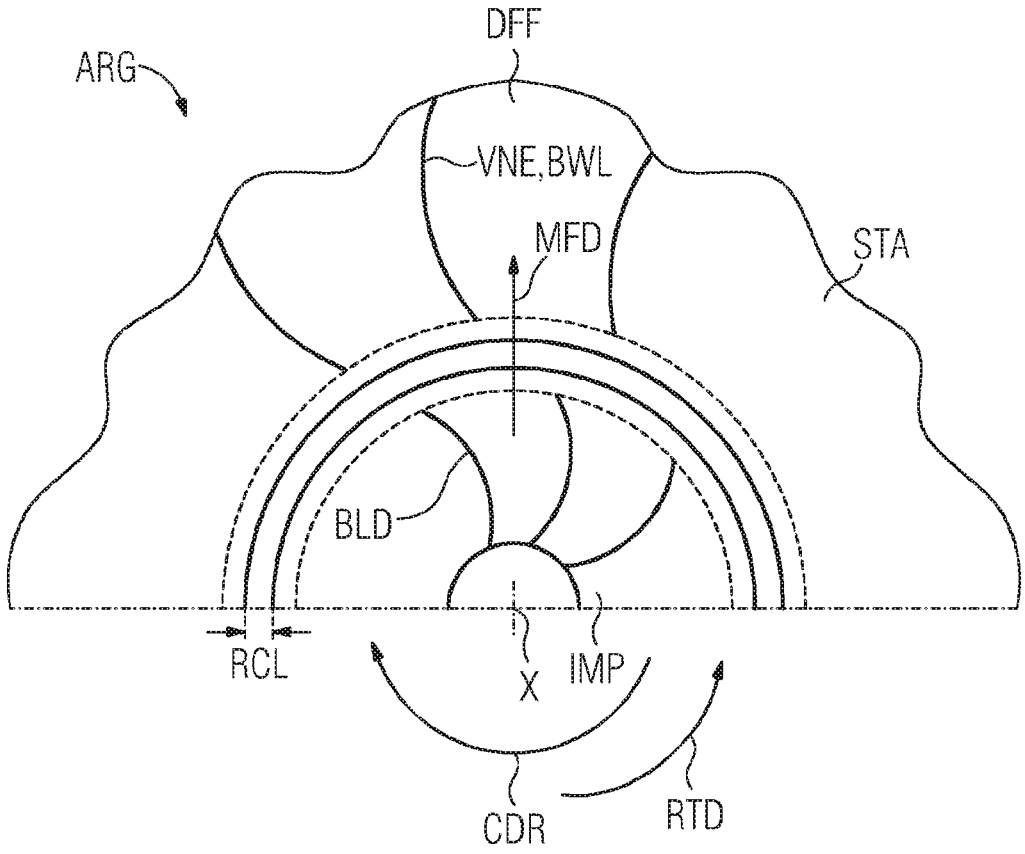
FIG. 3 shows a schematic cross section through an arrangement according to the invention.
Figure 4:
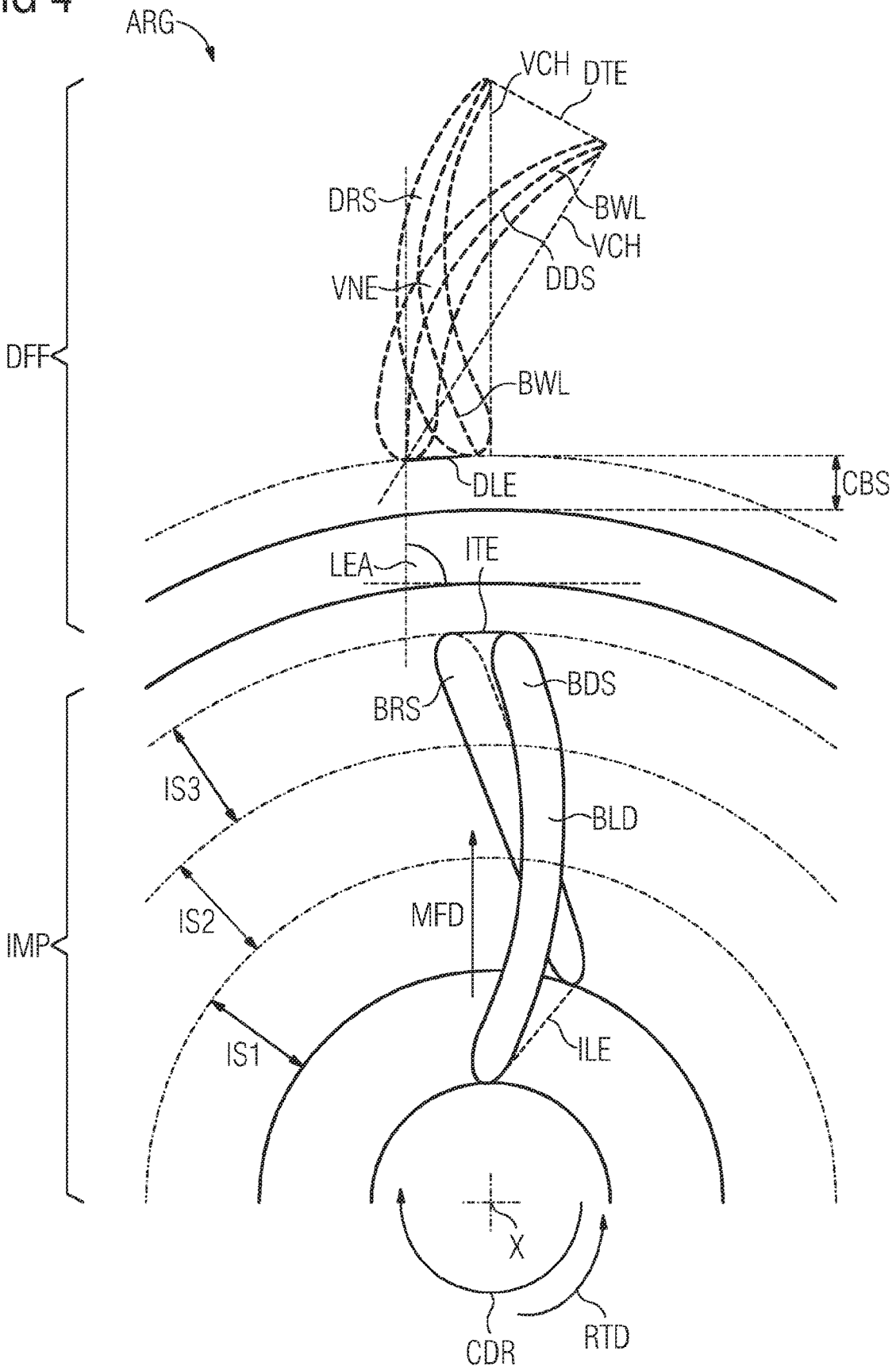
FIG. 4 shows a schematic cross section through an arrangement according to the invention with additional geometrical details.

FIGS. 1 and 2 show, in a schematic illustration, longitudinal sections through an arrangement ARG according to the invention, wherein FIG. 2 shows a detail in FIG. 1 that is denoted by II. An arrangement ARG according to the invention is flowed through by a process fluid PFF from an inlet INL to an outlet EXT along a main flow direction MFD. The arrangement ARG comprises an impeller IMP which is rotatable about an axis X in the direction of rotation RTD. An upright diffuser DFF equipped with guide vanes VNE is situated downstream of the impeller IMP. The impeller IMP has an inlet INI for a substantially axial inflow and has an outlet EXI for a substantially radial outflow. The suitability for the substantially axial inflow and the substantially radial outflow of the impeller is characterized by the profile of the flow channel extending through the impeller and of the impeller channels ICH. Radially and axially extending rotor blades BLD are situated between a wheel disk HWI and a cover disk SWI of the impeller IMP. The rotor blade channels ICH are delimited with respect to one another in a circumferential direction CDR by said rotor blades BLD, as can be seen in FIGS. 3 and 4. The diffuser DFF extends with diffuser flow channels along a main flow direction MFD, which extends substantially radially. The diffuser DFF has an axial cover disk side SWS and an axial wheel disk side HWS. This nomenclature is based on the arrangement of the cover disk SWI and the wheel disk HWI of the impeller IMP. The axial cover disk side SWS and the axial wheel disk side HWS of the diffuser DFF delimit between them an axial channel width SAC of the diffuser DFF. The diffuser DFF has a diffuser inlet IND for a substantially radial inflow and has a diffuser outlet EXD.

In FIG. 2, the diffuser is subdivided into three portions, into a first diffuser third TS1, a second diffuser third TS2 and a third diffuser third TS3, which extend along the main flow direction MFD. Guide vanes VNE extending axially along a vane height direction and radially along a throughflow direction extend between the wheel disk side HWS and the cover disk side SWS. The guide vanes VNE delimit individual guide vane channels HCN with respect to one another in a circumferential direction CDR.

Figure 5:
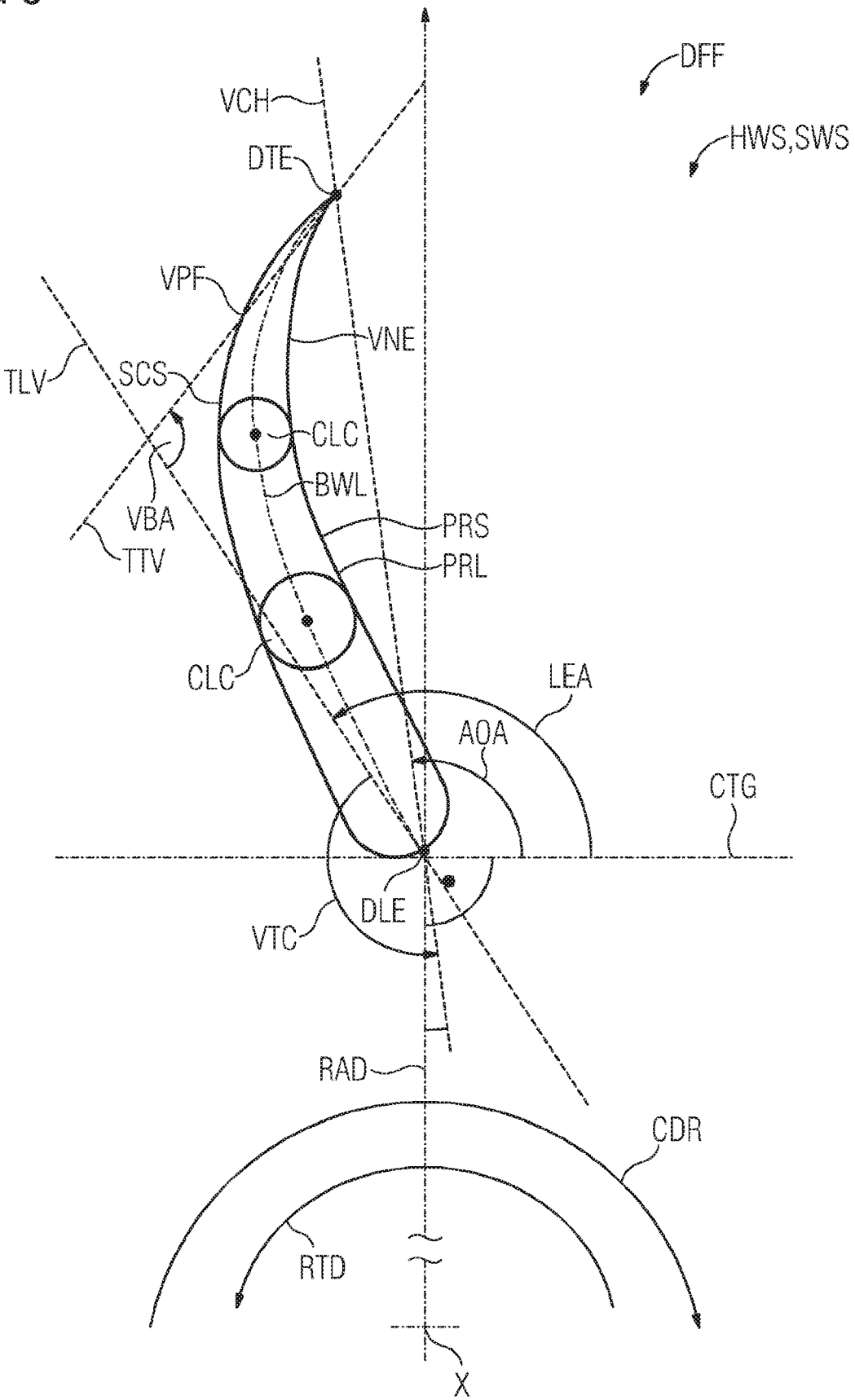
FIG. 5 shows a schematic cross section through a diffuser of an arrangement according to the invention in the region of a single guide vane.

In FIGS. 3, 4 and 5, a cross section of the arrangement ARG according to the invention or of a detail thereof is shown in each case, so that it is also possible to see how the guide vane channels HCN are delimited with respect to one another in a circumferential direction CDR by means of the guide vanes VNE. Since the guide vanes VNE naturally do not have a completely straight profile along the main flow direction MFD, the delimitation of this type is also to be understood accordingly. The individual guide vanes VNE can be defined as a stack of vane profiles PRL (for example vane profile PRL as illustrated in FIG. 5) along the vane height. The vane height extends, as shown in FIGS. 1 and 2, parallel to the axis X, that is to say axially. The vane profiles PRL themselves are two-dimensional geometries which define the vane outer contour at a particular vane height position. The actual outer contour of the vanes on the respective suction side SCS and pressure side PRS is obtained as a surface interpolation between the linear delimitation contours of the vane profiles PRL, which each indicate a linear specification at the respective vane height position (also axial position in this case).

FIG. 3 shows, in detail schematically in cross section, the arrangement ARG according to the invention having an impeller IMP and a diffuser DFF which adjoins downstream and which is designed as a stator STA. A radial clearance RCL of a radial gap is present between the impeller IMP and the diffuser DFF. In the illustration, the impeller IMP rotates counter to a circumferential direction CDR. The individual guide vanes VNE of the diffuser DFF are shown merely as schematic mean lines BWL. In this case, a mean line BWL describes a profile section or a profile of a vane at a particular height position in that the mean line BWL, also sometimes referred to as line of curvature, is a line defined by the center points of inscribed circles or circles tangent to the suction side and the pressure side of the profile. FIG. 5 shows in detail, on the basis of two circles CLC, by way of example, how the pressure side PRF and suction side SCS of a guide vane VNE define the mean line BWL by means of the inscribed circles CLC.

In this case, FIG. 5 shows merely an axial section through the diffuser DFF in the region of a guide vane VNS, wherein the illustration applies both to the cover disk side SWS and to the wheel disk side HWS.

FIG. 4 shows similar relationships in a combined view with the impeller IMP. There, the impeller IMP is divided into three portions of thirds which follow one another along the main flow direction MFD, more or less from a rotor blade inlet edge ILE to a rotor blade outlet edge ITE. In this case, the rotor blade inlet edge ILE and the rotor blade outlet edge ITE are not necessarily identical to the inlet INI of the impeller and the outlet XEI of the impeller, respectively. The main flow direction MFD extends axially in the impeller IMP too—that is to say also into the plane of the drawing in FIG. 4. The information about the axial extent is naturally lost in the axial projection of the rotor blades BLD in FIG. 4. The impeller has a first impeller portion IS1, a second impeller portion IS2 and a third impeller portion IS3. By contrast to FIG. 5, FIG. 4 shows, with dashed lines in each case, the cover disk side SWS and the wheel disk side HWS both for a rotor blade BLD and for a guide vane VNE.

It can be seen in particular in FIG. 5 that, for each axial vane, an inlet edge angle LEA is defined as the angle between an inlet edge tangent TLV of the respective guide vane VNE and a circumferential tangent CTG through the inlet edge DLE. In this case, the inlet edge angle LEA is measured in the mathematically positive sense from the circumferential tangent CTG to the inlet edge tangent TLV. The circumferential tangent CTG is a tangent in the circumferential direction at the respective indicated position, at the position of the inlet edge DLE in this case. Said circumferential tangent CTG can also be defined as being perpendicular to a radial RAD and the reference point, comprising the inlet edge DLE in this case.

FIGS. 4 and 5 also each show the profile chord VCH of the profile of the guide vane VNE in the respective section, said profile chord extending as a straight line from an inlet edge DLE to an outlet edge DTE. In a manner similar to that for the inlet edge angle LEA, based on the profile chord VCH, the angle of attack AOA is also defined as a mathematically positively measured angle from the circumferential tangent CTG to the profile chord VCH.

FIG. 4 shows these relationships for the cover disk side SWS and the wheel disk side HWS of the diffuser DFF. The arrangement ARG provides that, for the diffuser DFF, the inlet edge angle LEA is smaller on the cover disk side than on the wheel disk side. Advantageously, the difference between the cover disk-side and wheel disk-side inlet edge angles LEA is at least 5 degrees.

As also illustrated in FIG. 2, the quotient of axial channel width SAC of the diffuser DFF equipped with vanes and maximum impeller outlet diameter is greater than 0.04. It can likewise be seen in FIG. 2 that the quotient of axial channel width SAC of the diffuser equipped with vanes and axial channel width IAC of the impeller IMP at the maximum impeller outlet diameter DIE is less than 0.95. Particularly, as also illustrated in FIG. 5, the guide vane VNE is designed such that an angle, referred to as profile angle of curvature VBA in this case, between a tangent TLV to the mean line BWL in the inlet edge region and a tangent TTV to the mean line BWL in the outlet edge region TEA is smaller on the cover disk side than on the wheel disk side. The angle of curvature VBA is in this case also again measured in the mathematically positive sense, proceeding from the tangent TLV to the mean line BWL in the inlet edge region.

Also illustrated in FIG. 5 is an advantageous configuration of the invention such that an angle between the tangent TLV to the mean line BWL in the inlet edge region and the profile chord VCH is smaller on the cover disk side than on the wheel disk side, wherein the angle is referred to here as the inlet angle of attack VTC. It should be noted that FIG. 5 shows the relationships on the wheel disk side HWS or cover disk side SWS in a fundamentally schematic manner and accordingly represents both sides.

The illustration with superimposed profile sections in FIG. 4 becomes unclear when all of these geometrical relationships are marked.

An inlet edge DLE of the guide vanes VNE may advantageously, as illustrated in FIG. 4, be slightly radially offset downstream in relation to the inlet of the diffuser DFF, wherein this radial offset is indicated as CBS in FIG. 4.

FIG. 4 schematically shows the relationship whereby the guide vanes VNE have an inclination such that, on the cover disk side, the inlet edge VLE, in relation to the wheel disk-side inlet edge VLE, is offset counter to the direction of rotation RTD of the impeller IMP by at least 10% of the axial channel width SAC of the diffuser DFF. In this context, it is also expedient, as illustrated in FIG. 4, for the guide vanes VNE to be designed such that an offset counter to the direction of rotation RTD of the impeller IMP at the outlet edge DTE from the cover disk side SWS in relation to the wheel disk side HWS is smaller than at the inlet edge VLE. The axial profile of the guide vanes of the diffuser DFF from the cover disk side SWS to the wheel disk side HWS is of continuously curved form.

The invention claimed is:

1. An arrangement through which a process fluid is able to flow along a main flow direction, comprising: an impeller which is rotatable about an axis in a direction of rotation, and an upright diffuser which is situated downstream of the impeller and is equipped with guide vanes, wherein the impeller has an inlet for axial inflow and has an outlet for radial outflow, wherein radially and axially extending rotor blades are arranged between a wheel disk and a cover disk of the impeller and delimit impeller channels with respect to one another in a circumferential direction, wherein the diffuser extends radially along a main flow direction, wherein the diffuser has an axial cover disk side and an axial wheel disk side, which delimit between them an axial channel width of the diffuser, wherein the diffuser has a diffuser inlet for radial inflow and has a diffuser outlet, wherein guide vanes extending axially along a vane height direction and radially along a throughflow direction are arranged between the wheel disk side and the cover disk side of the diffuser and delimit guide vane channels with respect to one another in a circumferential direction wherein, for each axial vane height, an inlet edge angle is defined as the angle between an inlet edge tangent to a mean line at an inlet edge of the respective guide vane and a circumferential tangent through the inlet edge, wherein the inlet edge angle is smaller on the cover disk side than on the wheel disk side, and wherein the guide vanes are designed such that an angle between a tangent to the mean line in a region of the inlet edge and a tangent to the mean line in an outlet edge region is smaller on the cover disk side than on the wheel disk side.

2. The arrangement as claimed in claim 1, wherein a difference between cover disk-side and wheel disk-side inlet edge angles is at least 5°.

3. The arrangement as claimed in claim 1, wherein an angle of attack of the guide vanes is smaller on the cover disk side than on the wheel disk side.

4. The arrangement as claimed in claim 3, wherein a difference between cover disk-side and wheel disk-side angles of attack of the guide vanes is at least 5°.

5. The arrangement as claimed in claim 1, wherein the quotient of axial channel width of the diffuser equipped with vanes and maximum impeller outlet diameter is greater than 0.04.

6. The arrangement as claimed in claim 1, wherein the quotient of axial channel width of the diffuser equipped with vanes and axial channel width of the impeller at the maximum impeller outlet diameter is less than 0.95.

7. The arrangement as claimed in claim 1, wherein the guide vanes are designed such that an angle between a tangent to the mean line in an inlet edge region and a profile chord is smaller on the cover disk side than on the wheel disk side.

8. The arrangement as claimed in claim 1, wherein the guide vanes have an inclination such that, on the cover disk side, the inlet edge, in relation to a wheel disk-side inlet edge, is offset in the direction of rotation of the impeller by at least 10% of the axial channel width of the diffuser.

9. The arrangement as claimed in claim 1, wherein the guide vanes are designed such that an offset counter to the direction of rotation of the impeller at the outlet edge from the cover disk side in relation to the wheel disk side is smaller than at the inlet edge.

10. The arrangement as claimed in claim 1, wherein an axial profile of the guide vanes of the diffuser from the cover disk side to the wheel disk side is of continuously curved form.

11. The arrangement as claimed in claim 1, wherein the impeller has such a three-dimensional configuration that, at least in that third of the extent of the rotor blades along the main flow direction which is furthest downstream, an axial projection of a cover disk-side rotor blade track and a wheel disk-side rotor blade track has at least a projection, from the cover disk-side rotor blade track to the wheel disk-side rotor blade track, of at least a surface area >5% in relation to the cover disk-side rotor blade track surface.

12. The arrangement as claimed in claim 1, wherein the diffuser has such a three-dimensional configuration that, at least in that third of the extent of the guide vanes along the main flow direction which is furthest upstream, an axial projection of a cover disk-side guide vane track and a wheel disk-side guide vane track has at least a projection, from the cover disk-side guide vane track to the wheel disk-side guide vane track, of at least a surface area >5% in relation to the cover disk-side guide vane track surface.

* * * * *